US005931113A

United States Patent [19]

Eva, III et al.

[11] Patent Number: 5,931,113

[45] Date of Patent: Aug. 3, 1999

[54] FLOATING DRIVE ON DRY DOCK ASSEMBLY HAVING A SUPPORTING BEAM

[75] Inventors: W. Allan Eva, III; David T. Faber, both of Cleveland, Ohio

[73] Assignee: Ocean Innovations, Inc., Fort Lauderdale, Fla.

[21] Appl. No.: 08/928,878

[22] Filed: Sep. 12, 1997

[51] Int. Cl.[6] ..... B63B 35/44

[52] U.S. Cl. ..... 114/263; 114/266

[58] Field of Search ..... 114/44, 45, 46, 114/47, 48, 263, 258, 264, 265, 266

[56] References Cited

U.S. PATENT DOCUMENTS

| | | | |
|---|---|---|---|
| 2,453,155 | 11/1948 | Nelson et al. | 114/266 |
| 2,894,472 | 7/1959 | Foster | 114/45 |
| 3,276,211 | 10/1966 | Drake | 114/45 |
| 3,358,884 | 12/1967 | Link | 114/44 |
| 4,604,962 | 8/1986 | Guibault | 114/266 |
| 4,655,156 | 4/1987 | Svirklys et al. . | |
| 5,529,013 | 6/1996 | Eva, III et al. | 114/266 |

FOREIGN PATENT DOCUMENTS

| | | |
|---|---|---|
| 0 393 015 A1 | 4/1990 | European Pat. Off. . |
| 0 474 621 A1 | 3/1992 | European Pat. Off. . |
| WO 96/34793 | 7/1996 | WIPO . |

OTHER PUBLICATIONS

International Search Report, dated Oct. 5, 1998, International Application No. PCT/US98/17230, 4 pages.

*Primary Examiner*—Stephen Avila

*Attorney, Agent, or Firm*—Renner, Otto, Boisselle & Sklar, PLL

[57] ABSTRACT

A floating, drive-on dock for personal or commercial watercraft is assembled from a combination of hollow, air-tight floatation units. The dock includes a beam formed from a plurality of floatation units coupled together positioned underneath and attached to the dock to provide transverse support and lift for the floatation units and thereby reduce bowing or flexion when substantial forces are exerted, such as by large size watercraft, on the dock surface. Additionally, at least one of the floatation units that form the beam includes an aperture so that the buoyancy of that unit can be adjusted.

36 Claims, 4 Drawing Sheets

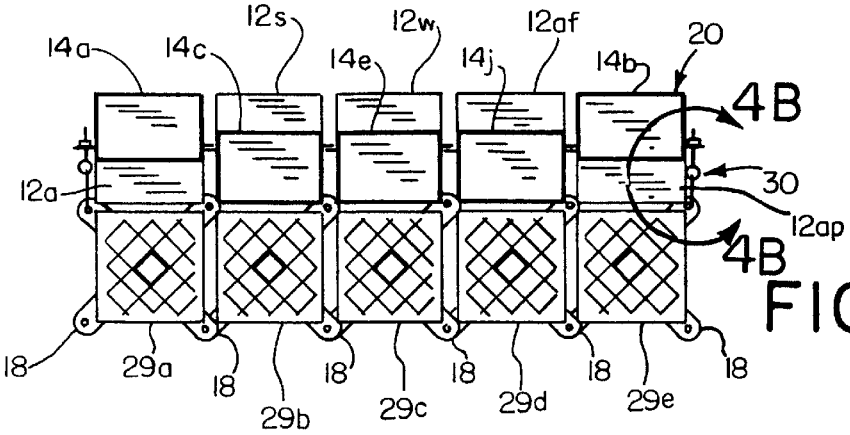
FIG. 4A
E D C B A
| | | | | | | | | | | |
|---|---|---|---|---|---|---|---|---|---|---|
| 12ag | 12ah | 12ai | 12aj | 12ak | 12al | 12am | 12an | 12ao | 12ap | 14b |
| 12x | 12y | 12z | 12aa | 12ab | 12ac | 12ad | 12ae | 12af | 14i | 14j |
| 12t | 12u | 12v | 12w | | 14h | | 14g | 14f | 14e | |
| 12k | 12l | 12m | 12n | 12o | 12p | 12q | 12r | 12s | 14d | 14c |
| 12j | 12i | 12h | 12g | 12f | 12e | 12d | 12c | 12b | 12a | 14a |
FIG. 6
E D C B A
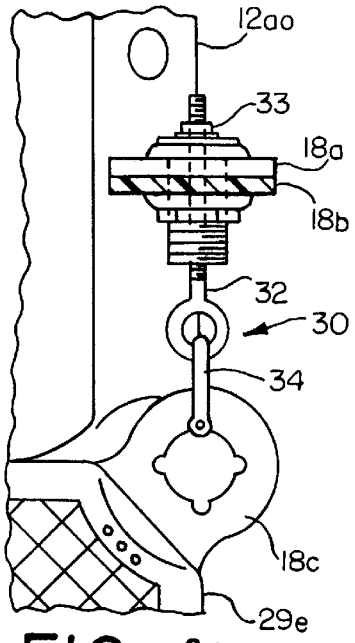
FIG. 4B
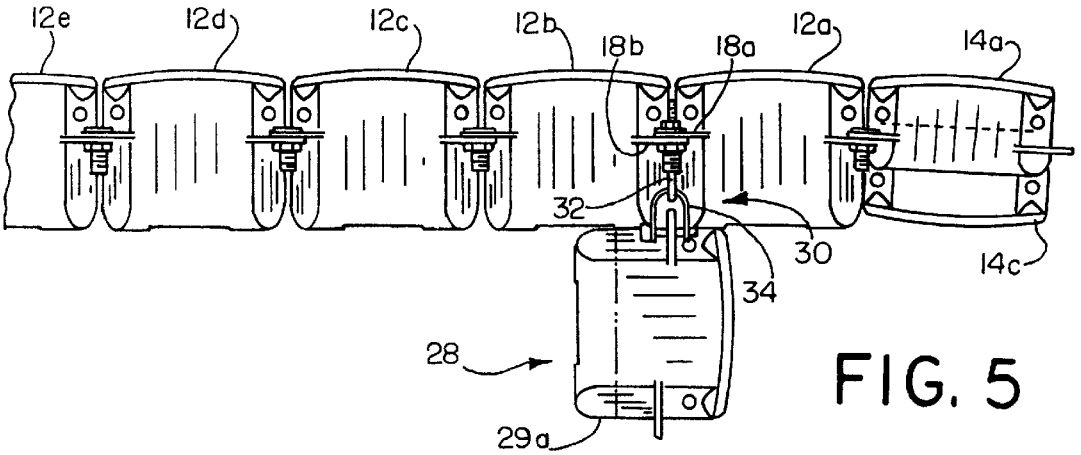
FIG. 5

FLOATING DRIVE ON DRY DOCK ASSEMBLY HAVING A SUPPORTING BEAM

FIELD OF THE INVENTION

The present invention relates to floating dry docks and particularly to a floating dry dock suitable for craft larger than personal water craft.

BACKGROUND OF THE INVENTION

In the past, floating dry docks have been created by the assembly of a number of identical floating subunits. These units have been roughly cubical with tabs projecting from the vertical edges at or near the horizontal midline. By fastening the adjacent tabs to each other, floating docks with substantially flat deck surfaces of many different configurations have been assembled.

Examples of such units and docks assembled from such units are found in U.S. Pat. Nos. 3,824,644 and 4,604,962. These patents describe hollow, roughly cubical floatation units which in practice have been manufactured about 16 to 20 inches on a side. The units have been molded from a suitable plastic material with tabs which project from each vertical edge positioned so that a dock of virtually any shape with a substantially flat deck or top surface could be formed. With a personal watercraft, such as a jet ski, or with other small craft, such as a motorboat or jet boat under about 18 feet in length, the goal of the floating dry dock has been to make it possible to drive the craft up onto the dock. This would enable the operator to get on and off the craft without getting in the water and would also permit the craft to be stored out of the water.

Attempts to accomplish these goals using the prior art floatation units described above have not been entirely successful. The dry docks assembled from such prior art units have been either too high above the water to permit a personal watercraft to be driven on, or too low to keep the driver and craft out of the water entirely. Keeping the craft high and dry when not in use is important to protect the machinery of the craft.

The above problem was addressed in U.S. Pat. No. 5,529,013 which describes a floating drive-on dry dock for personal watercraft or small craft. FIG. 1 shows a prior art dock constructed in accordance with the teachings of this patent. The dock 10 was assembled from a combination of tall and short hollow, air-tight floatation units. The tall units 12*a–l* are roughly cubical and have tabs projecting from about midway along their vertical edges. The short units 14*a–f* have tabs positioned to make an upper deck surface continuous with the deck surface formed by the tall units. The short units are able to flex downward when a craft is driven onto the dock, but resist flex in the opposite direction when the craft is in place and so form a stable surface that can be walked on.

The docks illustrated in FIG. 1 have been made wider in an effort to hold large, heavy watercraft. Such docks often experience a substantial bowing or flexion about the longitudinal centerline (keel) of the craft, thereby causing a substantial amount of stress on the tabs which connect the various subunits together and causing the craft to contact the water. An example of this problem is illustrated in FIG. 2, which is an end view of a dock similar to that shown in FIG. 1 but modified to be five cubes wide.

The tall units 12*a–l* (FIG. 1) are substantially all identical to each other, and in the subsequent description the reference numeral 12 without a suffixed letter is used to designate a tall unit generically, while the specific suffixes are used to refer to particular tall units. A similar nomenclature is used in connection with the short units 14*a–f*.

The tall units 12 are generally cubical, although the vertical edges 16 are beveled as shown in FIG. 1. A tab 18 projects from each beveled edge 16. The tabs are vertically staggered to facilitate connecting each floatation unit 12 to its neighbor, as illustrated schematically in FIG. 1. By staggering the distance down from the deck surface 20 of the tabs 18, it is possible to connect the tall floatation units with their top surfaces approximately coplanar so as to make a deck surface 20 for the dock 10 that is more or less flat and without abrupt steps.

The short floatation units 14 are similar to the tall units 12 except in the distance from the tabs to the bottom wall. The short units 12 have tabs 18 that are vertically positioned along the beveled corners 16 the same distance down from the deck surface 20 as are the corresponding tabs 18 of the tall units 12.

As a consequence of this arrangement, the short units 14 can be interconnected with the tall units 12, and the deck surface 20 produced will be generally planar and substantially without abrupt steps.

The floatation units 12 and 14 may consist of high density polyethylene (HDPE). This material has proven to be extremely rugged and to resist corrosion as well as the degradation resulting from attachment of marine flora and fauna. Moreover units which use HDPE exhibit an appropriate balance between flexibility and thickness. The tabs 18 are slightly more than ½ inch thick. Each of these tabs has a central opening 24 through which a fastener may be placed. Fasteners and openings like those shown in U.S. Pat. No. 3,824,644 have proved suitable for connecting floatation units 12 and 14 to each other where there are four tabs to be joined. Where three or fewer tabs are to be joined, a plastic nut and bolt assembly (not shown) has been used.

The prior art dock 10 of FIG. 1 is constructed so that surfaces on which a modest-size watercraft slides are submerged only while the watercraft is being ridden onto the dock 10, but which remain above the surface before and after the craft is driven onto the dock 10. The result is a dock that does not accumulate barnacles or other harmful marine growth on the surfaces which contact the craft. However, when the dock 10 of prior art FIG. 1 is expanded for use with a larger size watercraft, undesirable bowing and flexion is exhibited as illustrated in FIG. 2.

FIG. 2 is a view of a five cube wide prior art dock 21 looking endwise from the bow toward the stern. FIG. 2 illustrates a bowing or flexion caused by forces exerted on the deck surface 20 of the dock 21 in the direction F. The weight of a larger craft upon the deck surface 20 may cause the watercraft on the deck surface 20 to make contact with the water while stored on the dock 21. As discussed earlier, this disadvantageously causes the water to contact the bottom of the boat resulting in barnacles or other type degradation of the boat hull. Moreover with craft weighing in excess of 500 lbs, the cubes themselves may be distorted, resulting in even more bowing. Such a bowed dock may also be hard to walk on because of its slope.

As noted above, it is desirable for the craft to be entirely out of the water while docked. This enables the operators to enter their boat without getting in the water, and also enables the craft to be stored out of the water entirely. Keeping the boat out of the water entirely while stored on the dock is important to protect the machinery of the craft as well as to prevent marine growths, such as barnacles, from scratching the bottom surface of the craft each time the craft slides onto or off of the dock.

SUMMARY OF THE INVENTION

The present invention provides a floating drive-on dry dock for personal or commercial watercraft. The dock is assembled from a combination of hollow, air-tight floatation units. The dock may contain uniform sized floatation units or, alternatively, may be assembled from a combination of tall and short floatation units. Each floatation unit is roughly cubical and has tabs projecting along each vertical edge. The drive-on dry dock includes a beam or beams positioned at one or more selected location(s) underneath the dock to provide transverse support for the floatation units, thereby reducing bowing and flexion when substantial forces are exerted on the dock surface. During installation the beam is made neutrally buoyant by admitting water through one or more vent holes. If the dock requires additional buoyancy after the beam is installed, water is forced out of the beam floatation units and the vent holes may be plugged.

Accordingly, in one aspect of the invention, a floating dock assembly for a watercraft includes a plurality of floatation units which are connected to each other to form a dock surface. A beam is coupled to and positioned under the floatation units to provide support to the floatation units to reduce the bowing and flexion. The beam is oriented transverse to a longitudinal length of the dock assembly and may consist of a plurality of floatation units coupled together to provide additional lift to the dock.

In another aspect of the invention, a floating dock assembly for a watercraft includes a plurality of floatation units connected together to form a base and a pair of arms which extend from the base. The units of the base are joined to each other with their tabs defining a generally horizontal plane. The units have limited relative movement so as to form a substantially rigid structure, and flexible connections between at least some of the units of each arm permit each unit to pivot upward with respect to its immediately adjoining unit to a first extent and downward with respect to the same adjoining unit to a substantially greater extent. A beam is coupled to and positioned under the dock assembly and oriented transverse to the arms to thereby provide support to the dock assembly to reduce bowing when substantial downward forces are exerted on the top portion of the dock assembly. The beam may include a plurality of floatation units coupled together with their tabs defining a substantially vertical plane which provides additional lift to the dock.

According to another aspect of the invention, at least one of the plurality of floatation units that comprise the beam for supporting the dock assembly has an adjustable buoyancy mechanism to adjust the height in which the dock assembly rests in the water. The adjustable buoyancy mechanism may include a valve or a plug and opening assembly for allowing a fluid to enter and exit one or more of the floatation units which comprise the beam. This alters the buoyancy of the floatation units which comprise the beam and therefore also the buoyancy of the dock assembly itself.

The floating drive-on dry dock so constructed provides sufficient support and structural integrity to prevent substantial transverse bowing and flexion of the dock surface. This support structure is sufficient to keep a large sized watercraft, placed upon the dock, from contacting the water while being stored and does not impair lengthwise flexing of the dock which is important to enabling the craft to be driven onto the dock. The result is a high capacity, floating drive-on dock that prevents the accumulation of barnacles or other harmful marine growth on the watercraft and that is flat so that boaters may easily walk on it and that preserves the stern-to-bow sequential flexion enabling drive-on.

BRIEF DESCRIPTION OF THE DRAWINGS

FIG. 4A is a view of the dock according to the present invention looking in the direction of arrows 4—4 of FIG. 3;

FIG. 4B is a view of the coupling assembly;

FIG. 5 is a side view of the dock illustrated in FIG. 3, showing the location and attachment of the support beam;

FIG. 6 is a plan view of the dock of FIG. 3 showing various locations for a support beam along the length of the dock;

DETAILED DESCRIPTION OF THE INVENTION

Figure 3:
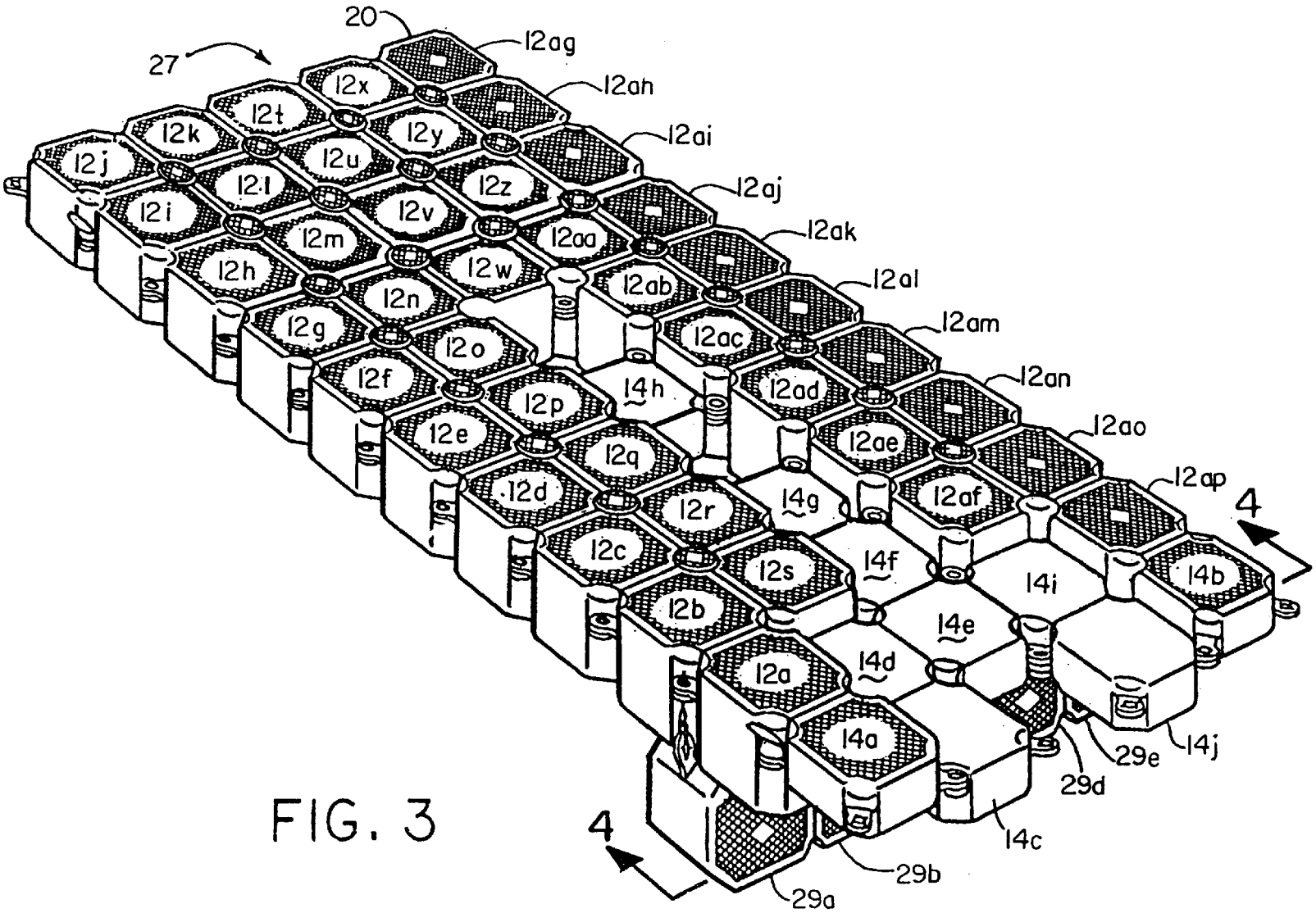
FIG. 3 is a schematic perspective illustration of a dock according to one aspect of the present invention, showing a transverse support beam.

The dock 27 shown in FIG. 3 is constructed in accordance with the present invention. The deck surface 20 is formed from short floatation units 14*a*–14*b* and tall floatation units 12*a*–12*ap* coupled together as in the prior art. In addition to the floatation units 12*a*–12*ap* and 14*a*–14*b* which form the deck surface 20, the dock 27 includes inverted short floatation units 14*c*–14*j*. These units are identical to the short units 14*a* and 14*b* but are installed upside down. The particular arrangement shown in FIG. 3 is typical for a 16 foot jet boat. The inverted short units 14*c*–14*j* provide a channel lower than the deck surface 20 in which the keel of the craft is guided as it is driven up on the dock.

The units 12 and 14 are the same as those shown and described in U.S. Pat. Nos. 3,824,664 and 4,604,962, the disclosures of which are incorporated by reference, and no further description is believed necessary. However it should be noted that the benefits of the present invention may also be obtained with a deck surface formed entirely of tall floatation units 12 or entirely of short floatation units 14 or with other combinations of tall and short units which are different than that illustrated.

The dock 27 is especially suited for large watercraft. Specifically, a dock like the dock 27 (but enlarged by the addition of more units 12 and 14) has proved suitable for use with craft up to 60 feet long and weighing up to 20,000 lbs. It will be understood from what follows that other configurations of the deck surface 20 are possible depending on the size and shape of the watercraft it is to support. The deck surface may be wider, or larger, or both, than the deck surface 20. Moreover, the present invention is applicable to deck surfaces with arms as illustrated and also to deck surfaces without such arms.

To accommodate such large craft, the dock 27 includes a support beam 28 coupled to and positioned under the floatation units comprising the deck surface 20 to reduce bowing and flexion when substantial forces are exerted by a large size watercraft. The beam 28 comprises five floatation units 29*a–e* (FIGS. 3 and 4), but it can be longer, depending on the size of the boat and the width of the dock. The floatation units 29*a–e* are identical to the tall floatation units 12 except that they have one or more vent holes drilled in them as is discussed more fully below. The floatation units 29*a–e* are joined to each other by means of the tabs 18 in the same manner (nuts and bolts) as are the units 12 and 14. The units 29 however, are oriented with their tabs 18 in a generally vertical plane. The resulting beam 28 is stiff against vertical loads.

The beam 28 is coupled to the dock 27 by means of coupling assemblies 30 (FIGS. 3, 4A and 4B) at each end of the beam 28. The coupling assemblies 30 are identical and FIG. 4B shows the coupling assembly on the starboard side of the deck 27. Each coupling assembly 30 includes an eye bolt 32 (FIG. 4B) which is fitted through a long D-shackle secured to an opening in the outboard tabs (18*a* and 18*b*) of the cubes on the edge of the deck. FIG. 4B shows the unit 12*a* and its tab 18*a*, while the tab 18*b* is part of the unit 12*a–p*. The coupling assembly 30 on the port side is the mirror image of the one shown.

A nut 33 (FIG. 4B) threaded into the eye bolt 32 keeps the eye bolt from pulling through the opening in the tabs 18 and permits the vertical position of the eye bolt 32 to be adjusted. Although FIG. 3 illustrates a deck surface 20 that is as wide as the beam 28 is long, such a construction is not necessary. For example, the beam 28 can be narrower than the dock (seven cube dock with a five cube beam), or conceivably the reverse.

Each coupling assembly 30 (FIG. 4B) also includes a D-shackle 34. The bottom of the shackle 34 engages the tab 18*c* on cube 29*e* which is part of the beam 28. The other end of the shackle 34 engages the eye bolt 32. When the shackle 34 is in place, the nut 33 holding the eye bolt in place is tightened to draw the beam 28 tightly against the bottom of the deck. In this manner, the coupling assembly 30 allows for the adjustment of pre-load on the beam 28. Other hardware is possible to perform the function of the shackle 34. Its chief function is to transmit tensile loads between the tabs 18*a* and 18*b* of the deck and the tab 18*c* on the beam 28.

Figure 1:
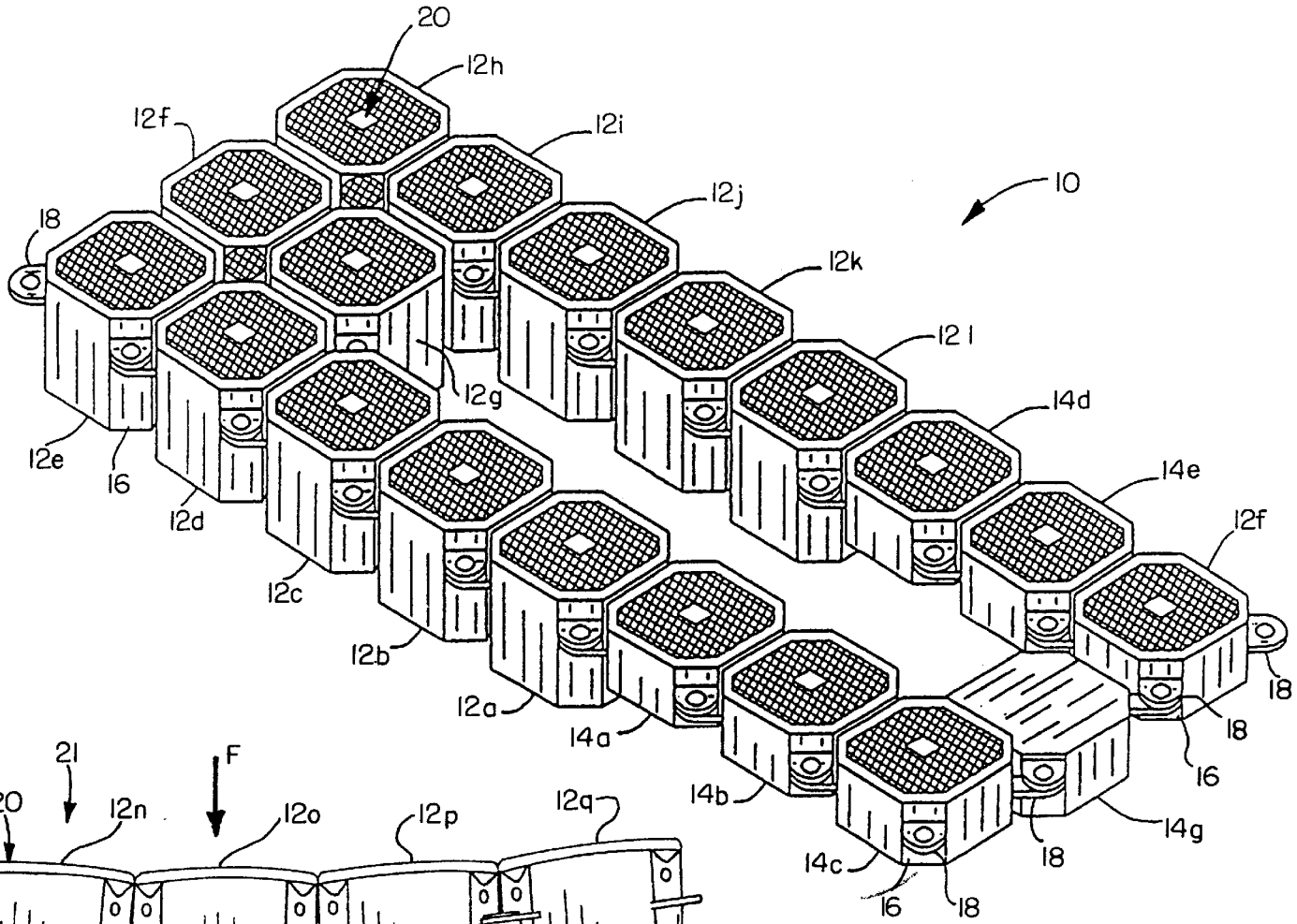
FIG. 1 PRIOR ART
FIG. 1 is a schematic perspective illustration of a prior art dock for a watercraft.
Figure 2:
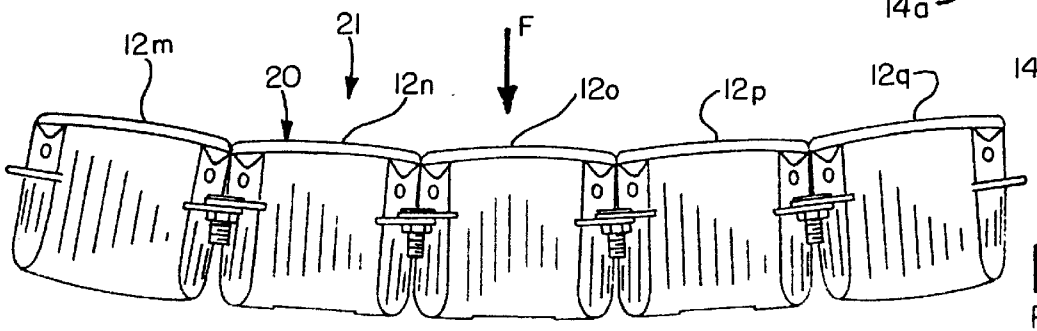
FIG. 2 PRIOR ART
FIG. 2 is an end view of a prior art dock like that of FIG. 1, but widened by the addition of two rows of cubes, looking from the bow toward the stern and showing bowing due to substantial downward forces exerted on the top surface.

With the beam 28 positioned under the units 12 which form the deck surface 20, additional floatation or lift is provided for the dock 27. By coupling the ends of the beam 28 to the deck 20 the rigidity of the beam keeps the deck flat, even when a large craft is on the deck. Without the beam 28, a large craft would tend to curl the edges of the deck 20 upward as its weight pushes down along the centerline of the dock 27 as illustrated in FIG. 2. This is termed "transverse flexing" and it may make the dock 27 difficult to walk on and may allow the bottom of a large craft to remain in the water even when it is on the dock. With the beam 28 installed, the deck 20 is held flat, and all the units 12 above the beam 28 submerge at substantially the same time and to substantially the same extent, so reducing or eliminating transverse flexion.

Although FIG. 3 illustrates a deck surface 20 that is as wide as the beam 28 is long, such a construction is not necessary. For example, the beam 28 can be narrower than the dock (seven cube dock with a five cube beam), or conceivably the reverse. It should be understood that the present invention is applicable to docks having varying widths. It should also be recognized, that the wider a dock becomes to accommodate a larger watercraft or greater number of watercraft, bowing may be a greater problem, thereby increasing the utility of the beam 28.

FIG. 5 is a side view of the dock 27 of FIG. 3, FIG. 5 providing additional clarity in illustrating the coupling mechanism 30 which is utilized to couple the beam 28 to the dock assembly. The coupling mechanism 30 includes the eye bolt connector 32, physically attached to the tabs 18 of the floatation units 12*a* and 12*b*, which couples to the beam unit 29*e* via the D-shackle 34. The D-shackle 34 may be replaced with any inelastic link, such as a length of chain, a C-shaped hook, or a bolt and fork terminal.

Although FIGS. 3–5 have illustrated the beam 28 in a position centered on a line A—A in FIG. 6 between the floatation units 12*a* and 12*b* and 12*ao* and 12*ap*, respectively, it should be understood that the beam 28 may be located at any lengthwise location along the dock 27 as the circumstances require. For example, as illustrated in FIG. 6, a beam may be secured at locations along lines A through E along the dock's length. The location selected will depend in part on the craft to be docked since generally the beam 28 should be under the center of gravity of the craft when it is on the dock. Moreover, it should also be understood that one or more beams may be utilized at various locations along the length of the dock 27 depending on the length, width and weight of the watercraft to be parked on the dock.

It will be understood that the dock 27 is illustrative only, and that other configurations are possible to accommodate different sizes and types of watercraft. For example, floating docks having a supporting beam may be assembled for use with long-length watercraft, outboard motorboats, sailboats having a centerboard, and other types of craft. Moreover, docks having a supporting beam may be assembled with slips for two or more watercraft without departing from the scope of the invention.

Figure 7A:
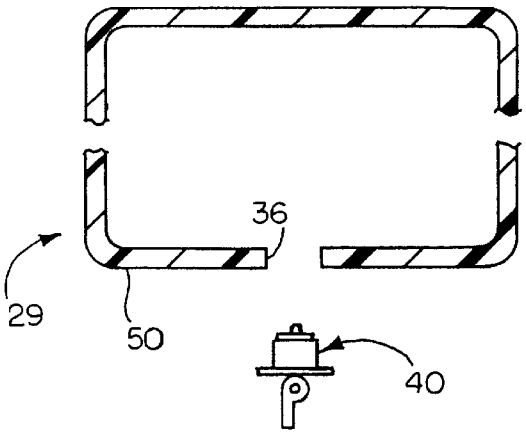
FIG. 7A is a diagram illustrating, partially in cross-section, a floatation unit having an adjustable buoyancy mechanism.
Figure 7B:
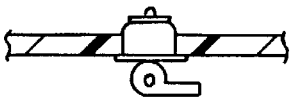
FIG. 7B is a view like FIG. 7A but showing a bailer plug secured within an opening in the floatation unit.

FIGS. 7A and 7B are diagrams which illustrate an adjustable buoyancy mechanism which may be utilized in the beam 28. A beam floatation unit 29 includes a lowermost surface 50 having an opening 36. The opening may be formed by drilling a 1 inch hole in the side wall of the unit 29. A conventional bailer plug 40 forms a tight fit with the opening 36 when it is installed as shown in FIG. 7B to seal the opening. Of course, other types of plugs, including threaded plugs, could be used. The bailer plug 40 is convenient because a conventional floatation unit 12 can be modified for use as part of the beam 28 merely by drilling a hole in it.

Figure 8A:
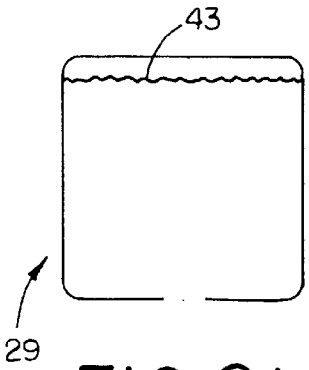
FIG. 8A is a cross-sectional diagram illustrating a floatation unit having a first buoyancy.
Figure 8B:
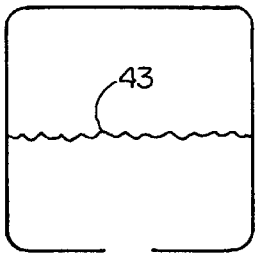
FIG. 8B is a cross-sectional diagram illustrating a floatation unit having a second buoyancy.
Figure 8C:
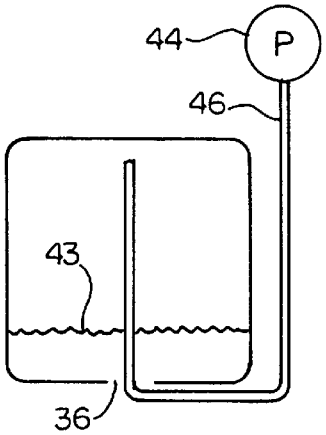
FIG. 8C is a cross-sectional diagram illustrating a floatation unit and an air compressor and air hose for altering a buoyancy at a floatation unit.

When the plug 40 is removed from the opening 36, fluid may enter or exit to alter the floatation unit's buoyancy in the water. FIGS. 8A–8C show a floatation unit 29 filled with water to varying levels to adjust its buoyancy. In FIG. 8A, a floatation unit 29 has a limited amount of lift because water fills a substantial amount of its volume. The waterline 43 is near the top of the floatation unit 29, and therefore the buoyancy of the unit 29 is low and the unit rests deeply in the water. In FIG. 8B, a middle degree of buoyancy is illustrated with the water (shown by the waterline 43) filling approximately onehalf of the floatation unit 29. In this state, because a substantial amount of the volume of the floatation unit 29 is occupied with air, it is more buoyant and therefore rises higher in the water than in FIG. 8A. FIG. 8C illustrates a floatation unit 29 having a high amount of buoyancy. The waterline 43 is near the bottom of the floatation unit 29 and therefore it has a greater buoyancy than that shown in FIGS. 8A and 8B, and the unit 29 is only partially submerged. These buoyancies can be adjusted more than once and as frequently as with each use of the dock or as necessary with the assistance of an air compressor or other bailing device.

The amount of buoyancy may be adjusted to provide for adjustments in the degree to which the dock is submerged in the water when a substantially large craft is at rest on the dock. For example, if the dock is to accommodate a heavy craft, greater buoyancy will be desired. FIG. 8C additionally illustrates a method by which the buoyancy state of the floatation unit may be adjusted. This is done by pumping air into the cube to the desired level. The plug 40 may be removed from the opening 36 of the floatation unit 29 and a compressor 44 having an air hose 46 attached thereto may be placed within the opening 36, and air or another like fluid may be injected into the floatation unit 29 via the compressor 44 and hose 46. The injection of the air displaces the water from the floatation unit and thereby increases the buoyancy of the unit 29. After achieving a desired buoyancy, the hose 46 is removed and the plug 40 is again locked into the opening 36 to seal it. In this manner, the beam 28 may have a buoyancy which may be adjusted and altered at a user's discretion. The air hose 46 may be held in place by clips (not shown) which are permanent. A manifold arrangement may be used to connect the air compressor 44 to all of the beam's floatation units, e.g.,units 29*a*–29*e* of FIG. 4. In this way air, and thus the buoyancy may be added as desired. Moreover, if the uppermost end of the hose 46 extends up above the surface 43 of the water within cube 29, the buoyancy of cube 29 may be decreased by selectively venting the air within the cube to the atmosphere through the hose 46 to enable craft to more easily access the top surface 20 of the dock. The buoyancy of the beam 28 may also be adjusted by utilizing floatation units having different volumes to thereby customize a beam to have a particular buoyancy. All of these methodologies are contemplated in the present invention.

It will be readily apparent that the removable bailer plug 40 can be used to advantage during installation of the beam 28 (FIG. 3). The upper layer of the dock 27 (units 12 and 14) can be assembled in the usual way and placed in the water. Next the beam 28 is assembled from floatation units 29*a*–29*e*. The plug 40 is removed from each floatation unit 29*a*–*e*, and the units are flooded with water, so that they become essentially neutrally buoyant. In this state, the beam 28 can be maneuvered into position under the dock 27 and secured in place. Next, the airline 46 can be used to fill each unit 29*a*–*e* with air to desired degree and then sealed by means of the plug 40.

In use, a watercraft may be driven onto the dock 27. This is done by centering the watercraft at a central location (over the floatation unit 14*e* (FIG. 3)) at the stem end of the dock 27. By applying a burst of power to the craft, the craft moves forward, and its momentum carries it to a resting position on the dock 27. During this process, the floatation units comprising the deck surface 20 may be partially submerged in the water. However, when the craft is completely on the dock 27, the beam 28 provides substantial support along a transverse direction of the dock and/or selected additional buoyancy to ensure that the craft does not contact the water while being stored on the dock 27. The result is a dock 27 that does not accumulate barnacles or other harmful marine growth about areas in direct contact with the craft, thereby protecting the stored craft.

Although the invention has been shown and described with respect to a certain preferred embodiment, it is apparent that equivalent alterations and modifications will occur to others skilled in the art upon the reading and understanding of the specification and the annexed drawings. With particular regard to the various functions performed by the above described components, assemblies, devices, etc., the terms, including a reference to a means used to describe such components, are intended to correspond, unless otherwise indicated, to any component which performs the specified function of the described components (i.e., that is functionally equivalent), even though not structurally equivalent to the disclosed structure which performs the function. In addition, while a particular feature of the invention may have been described above with respect to only one of several illustrated embodiments, such feature may be combined with one or more other features of the other embodiments as may be desired and advantageous for any given application.

What is claimed is:

1. A floating dock assembly for a watercraft, the assembly comprising:

a first group of floatation units connected to each other to form a dock surface to support the watercraft above the surface of the water, the dock surface having a longitudinal axis extending fore and aft of the watercraft and a transverse axis extending abeam of the watercraft when the watercraft is on the dock surface; and a beam coupled to and positioned under the first group of floatation units, the beam extending in the direction of the transverse axis of the dock surface, the beam comprising a second group of floatation units coupled together to support the first group of floatation units, thereby providing lift and reducing bowing and flexion of the dock assembly when the watercraft is on the dock surface.

2. The dock assembly of claim 1, wherein at least one of the floatation units which comprise the beam includes a sealable opening for admitting fluids to the unit to control the buoyancy of the unit.

3. The dock assembly of claim 2, wherein the sealable opening comprises a valve for allowing a fluid to enter and exit the floatation unit, thereby altering the buoyancy of the floatation unit.

4. The dock assembly of claim 1, wherein the beam is coupled to a plurality of tabs which project from the sides of the floatation units which form the dock surface.

5. The dock assembly of claim 4, wherein the plurality of floatation units comprising the beam have sides with tabs projecting therefrom, and the tabs of adjacent units are connected to each other to form the beam.

6. The dock assembly of claim 5, wherein the tabs of the beam are coupled to the tabs of the units which form the dock surface.

7. The dock assembly of claim 1 wherein the beam extends transverse to the longitudinal axis of the dock.

8. A floating dock assembly for a watercraft, the assembly having a top and bottom portion and comprising:

a plurality of floatation units connected to each other to form a base, and a pair of arms extending from the base;

the units of the base being joined to each other for limited relative movement so as to form a substantially rigid structure, and flexible connections between at least some of the units of each arm, the flexible connections between the units permitting each unit to pivot upward with respect to its immediately adjoining unit to a first limited extent and downward with respect to the same adjoining unit to a substantially greater extent; and a beam coupled to and positioned under the bottom portion of the dock assembly and oriented transverse to the arms, the beam being buoyant and being relatively stiff against bending in a vertical plane so as to provide lift and reduce bowing and flexion when substantial downward forces are exerted by a watercraft on the top portion of the dock assembly.

9. The dock assembly of claim 8, wherein the beam comprises a plurality of floatation units coupled together.

10. The dock assembly of claim 8, wherein the beam is coupled to a plurality of tabs which project from a side of two or more of the floatation units which form the base and arms of the dock assembly.

11. The dock assembly of claim 10, wherein the beam comprises a plurality of floatation units having tabs projecting from the sides, the tabs coupling the floatation units together, wherein the tabs projecting from the floatation units which form the beam are coupled to the tabs of two or more of the floatation units which comprise the base.

12. The dock assembly of claim 10, wherein the beam comprises a plurality of floatation units having tabs projecting from the sides, the tabs of adjacent units beings connected to each other to form the beam, the tabs of two or more of the floatation units comprising the beam being coupled to the tabs of the plurality of floatation units that comprise the arms.

13. The dock assembly of claim 9, wherein at least one of the floatation units which comprise the beam has an adjustable buoyancy mechanism to thereby adjust a height at which the dock assembly rests in the water.

14. The dock assembly of claim 13, wherein the adjustable buoyancy mechanism comprises a valve for allowing a fluid to enter and exit the floatation units, thereby altering the buoyancy of the floatation units.

15. A floating, drive-on dock onto which a watercraft may be driven, the dock comprising:

a plurality of floatation units connected to each other, the dock having a proximal end, a distal end and a midsection region between the two ends, whereby craft may approach the dock from the distal end;

first means for connecting the floatation units at the proximal end of the dock to each other so that they have limited and substantially equal angular movement about a horizontal axis relative to each other;

second means for connecting the floatation units at the distal end of the dock to each other so that they have limited angular movement relative to each other about a horizontal axis in one angular direction and substantially greater angular movement relative to each other in the opposite angular direction about said horizontal axis; and third means for adding buoyancy to the plurality of floatation units and for reducing bowing and flexion when substantial downward forces are exerted on the dock.

16. The dock of claim 15, wherein the third means comprises a beam positioned under the floatation units and transverse to a longitudinal length of the dock.

17. The dock of claim 15, wherein the third means is positioned in a region between the proximal end and the midsection region of the dock.

18. The dock of claim 15, wherein the third means comprises a plurality of floatation units coupled together, the floatation units of the third means and the floatation units of the proximal end all have substantially the same conformation.

19. The dock of claim 18, wherein at least one of the floatation units which comprise the third means includes an adjustable buoyancy mechanism to thereby adjust a height in which the dock assembly floats in the water.

20. The dock of claim 19, wherein the adjustable buoyancy mechanism comprises a valve for allowing a fluid to enter and exit the floating units, thereby altering the buoyancy of the floatation units.

21. A floating, drive-on dry dock comprising a plurality of tall floatation units and a plurality of short floatation units, the tall and short floatation units being joined to each other to form a dock surface, the tall and short floatation units each having substantially vertical side walls joined to each other at comers where the adjacent side walls meet, and the short and tall floatation units each having substantially horizontal top and bottom surfaces joined at edges with the side walls, the top and bottom surfaces of all the floatation units having substantially the same rectangular contour, and the side walls of the tall floatation units being taller than the short floatation units, all of the floatation units having flexible tabs extending generally horizontally outward from their corners and positioned to connect with tabs from adjacent floatation units, the tabs being adapted to position adjacent floatation units a predetermined distance from each other when the tabs of adjacent floatation units are connected to each other and the side walls of the adjacent floatation units are parallel, the tabs extending from tall floatation units being substantially midway along the vertical height of the tall floatation units, the dock having a first end portion including a plurality of tall floatation units with their tabs connected to each other, and a second end portion including a plurality of short floatation units with their tabs connected to each other, tabs on the first and second portions being connected to each other, whereby the units in the first portion are free to pivot about a horizontal axis through the tabs in an upward and downward direction until the top and bottom surfaces, respectively, of adjacent units come into contact, the extent of rotation about said axis being substantially equal in both directions from an initial position in which the adjacent side walls are parallel, and the units in the second end portion of the dock are free to pivot upward about a horizontal axis through the tabs to the same extent as the units in the first end portion and downward about said axis a substantially greater extent; and the dock having a beam coupled to and positioned under the dock and positioned transverse to the length of the dock, wherein the beam provides support to the dock to reduce bowing and flexion when substantial downward forces are exerted on the dock.

22. The dock of claim 21, wherein the beam is positioned under the first end portion of the dock.

23. The dock of claim 21, wherein the beam comprises a plurality of floatation units coupled together.

24. The dock of claim 23, wherein at least one of the floatation units which comprise the beam has an adjustable buoyancy mechanism to thereby adjust a height in which the dock rests in the water.

25. The dock of claim 24, wherein the adjustable buoyancy mechanism comprises a valve for allowing a fluid to enter and exit the floatation units, thereby altering the buoyancy of floatation units.

26. The dock of claim 24, wherein the beam is coupled to a plurality of tabs which project from a side of the floatation units which form the first end portion.

27. The dock of claim 24, wherein the beam is coupled to a plurality of tabs which project from a side of the floatation units which form the second end portion.

28. A floating, drive-on dock formed from a plurality of floatation units each with a generally flat top surface, the floatation units being connected together so that their top surfaces are generally coplanar and horizontal, and each floatation unit having at least one side wall which faces an opposing side wall on an adjacent floatation unit, each floatation unit having a pivotable connection to the adjacent floatation unit, the connections being above the water line when the dock is floating freely and a fixed distance below the top surface of the floatation unit and enabling adjacent floatation units to rotate with respect to each other until the respective facing side walls come into contact with each other, a first group of the floatation units having bottom surfaces located substantially as far below the pivotable connection as their top surfaces are above the pivotable connection whereby they can rotate downward to the same extent they can rotate upward before the respective facing side walls come into contact with each other, a second group of floatation units having bottom surfaces located substantially closer to the pivotable connection whereby they can rotate downward substantially without limitation, said floating dock having a pair of parallel arms formed at least in part of floatation units from said second group of floatation units, and a bridging unit between said parallel arms, said bridging unit having a top surface which is above the water surface when the dock is floating freely; and a beam coupled to and positioned under the plurality of floatation units and positioned transverse to a longitudinal length of the dock, wherein the beam provides support to the plurality of floatation units, thereby reducing bowing and flexion when substantial forces are exerted, such as by large size watercraft, on the dock.

29. The dock of claim 28, wherein the beam comprises a plurality of floatation units coupled together, the floatation units of the beam being substantially of the same size and shape as the floatation units of one of the first and second groups of floatation units.

30. The dock of claim 29, wherein the beam is coupled to a plurality of tabs which project from a side of two or more of the plurality of floatation units.

31. The dock assembly of claim 1, wherein adjacent floatation units in the second group of floatation units are coupled to each other.

32. The dock assembly of claim 9, wherein adjacent floatation units in the beam are coupled to each other.

33. The dock of claim 16, wherein the beam is substantially positioned under the center of gravity of the watercraft when it is on the dock.

34. The dock of claim 15, wherein the third means comprises a plurality of floatation units and wherein adjacent ones of these floatation units are joined together.

35. The dock of claim 23 wherein adjacent floatation units in the beam are coupled together.

36. The dock of claim 28 wherein the beam comprises a plurality of floatation units and wherein adjacent ones of these floatation units are joined together.

* * * * *